US006691538B1

(12) United States Patent
Yang et al.

(10) Patent No.: US 6,691,538 B1
(45) Date of Patent: Feb. 17, 2004

(54) ENHANCED DOOR LOCK CAPABLE OF BEING LOCKED FROM INNER SIDE OF DOORPLATE

(76) Inventors: Chen Feng Yang, 235 Chung-Ho Box 8-24, Taipei (TW); Sheng Chu Yang, 235 Chung-Ho Box 8-24, Taipei (TW); Mu Kuei Yang, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/316,807

(22) Filed: Dec. 12, 2002

(51) Int. Cl.[7] ..... E05B 9/08

(52) U.S. Cl. ..... 70/370; 70/468; 70/481; 70/483; 292/347; 292/359

(58) Field of Search ..... 292/347–357, 292/358, 359, DIG. 64; 70/467–471, 477, 478, 481, 483, 152, 370, 450, 451

(56) References Cited

U.S. PATENT DOCUMENTS

| | | | | | |
|---|---|---|---|---|---|
| 283,380 | A | * | 8/1883 | Cooper | 292/347 |
| 527,560 | A | * | 10/1894 | Rumsey | 292/359 |
| 831,745 | A | * | 9/1906 | Rice | 403/321 |
| 3,896,644 | A | * | 7/1975 | Nagy et al. | 70/149 |
| 4,575,141 | A | * | 3/1986 | Burns | 292/336.3 |
| 5,950,467 | A | * | 9/1999 | Dong | 70/467 |
| 6,145,358 | A | * | 11/2000 | Wu | 70/467 |
| 6,164,099 | A | * | 12/2000 | Sh | 70/134 |
| 6,264,255 | B1 | * | 7/2001 | Fortune | 292/336.3 |

* cited by examiner

*Primary Examiner*—John B. Walsh

(57) ABSTRACT

An enhanced door lock is capable of being locked from an inner side of a doorplate. At the outer lock portion, a ring seat and a C ring clamp two sides of the outer plate of the doorplate so as to enhance the structure of the doorplate to prevent the door lock from being pulled out. The inner cover is installed with a positioning hole. One side of a top of the control knob is drilled with a stud receiving groove. A positioning pin is placed in a stud receiving groove. The outer sleeve and the stud of the positioning pin are coupled with the stud receiving groove; then the bead resisting against the spring exactly pushes the positioning groove of the stud to resist against a positioning groove. By this structure, the lock is locked from the inner side of the doorplate.

5 Claims, 5 Drawing Sheets

ENHANCED DOOR LOCK CAPABLE OF BEING LOCKED FROM INNER SIDE OF DOORPLATE

FIELD OF THE INVENTION

The present invention relates to door locks, and particularly to a enhanced door lock capable of being locked from an inner side of a doorplate.

BACKGROUND OF THE INVENTION

In the prior art, the door lock has an outer lock portion and an inner lock portion. The outer lock portion and inner lock portion are installed at two sides of a doorplate.

Referring to U.S. Pat. No. 5,950,467, a prior art door lock structure is disclosed in the patent. In the prior art, a door lock is installed in the door body of a door and operated to lock/unlock the door. The door lock comprises an external locking unit mounted on an outer face panel of the door body of the door, an internal locking unit mounted on an inner face panel of the door body of the door, and a locking bolt unit driven by the external locking unit to lock/unlock the door body of the door. The external locking unit comprises a casing, an outside knob, and a lock cylinder. The internal locking unit is comprised of a circular base block, a rotary cover mounted on the circular base block, a sliding knob, and a shaft.

The casing of the external locking unit comprises a circular base shell fixedly fastened to the outer face panel of the door body, a circular recess at the center of the circular base shell at one side, which holds the lock cylinder, a circular center hole through the center of the circular recess, two parallel nuts perpendicularly raised from the circular base shell and inserted into the inside of the door body.

The outside knob of the external locking unit is mounted on the circular base shell of the casing of the external locking unit to hold the lock cylinder in the circular recess of the circular base shell.

The lock cylinder of the external locking unit is fixedly fastened to an inner face panel of the door body of the door, comprising a circular center hole in paid circular base block, which receives the shaft and connected to the nuts of the casing of the external locking unit, an annular groove at one side around the circular center hole thereof, and a notch perpendiculary extended from the annular groove.

The rotary cover of the internal locking unit is mounted on the circular base block, comprising a handle, a center hole, which receives one end of the shaft, a through hole axially extended through the handle and intersected with the center hole thereof, a headed sliding rod axially moved in the through hole in the handle and perpendicularly connected to the sliding knob of the internal locking unit, the headed sliding rod having a locating groove on the periphery thereof, an oblong hole, a threaded locating hole, and a spring-supported locating device mounted in the threaded locating hole and engaged into the locating groove at the headed sliding rod to hold the headed sliding rod in position.

The sliding knob of the internal locking unit is coupled to one end of the headed sliding rod outside the rotary cover, having a lock pin connected to one end thereof. The lock pin is extended through the oblong hole on the rotary cover and perpendicularly inserted into the annular groove at the circular base block of the internal locking unit and moved with the sliding knob between a first position wherein the lock pin is engaged into the notch at the circular base block of the internal locking unit to stop the rotary cover from rotary motion relative to the circular base block of the internal locking unit, and a second position wherein the lock pin is disengaged from the notch at the circular base block of the internal locking unit, allowing the rotary cover to be rotated on the circular base block of the internal blocking unit.

However, the prior art has the following defects. At first, too many components are necessary and thus assembly work is complicated and cost is high. Secondary, steer forces are existed are many portions of the structure and thus the support and strength is weak. As a result, the lock structure is weak. Assembly of inner lock is complicated and can not be used to match the current door lock so that the current used lock must be deserted for updating this prior art lock.

SUMMARY OF THE INVENTION

Accordingly, the primary object of the present invention is to provide an enhanced door lock capable of being locked from an inner side of a doorplate. An outer thread is formed on an outer edge of an outer periphery of the ring seat. The outer thread is engageable with an inner thread at an inner edge of the outer lock casing. An interior of outer plate of the doorplate has a C ring coupled to the outer ring seat. An inner side of the ring seat has connecting ears and an inner side of the C ring is installed with connecting ears. The connecting ears of the C ring are configured with respect to the connecting ears of the ring seat. Each connecting ear has a penetrating hole and each connecting ear has a screw hole. The connecting ears of the C ring and connecting ears of the ring seat are locked by screws. Thereby, the ring seat and C ring clamps two sides of the outer plate of the doorplate so as to enhance the structure of the doorplate to prevent the door lock from being pulled out.

Another object of the present invention is to provide an enhanced door lock capable of being locked from an inner side of a doorplate, wherein the inner cover is installed with a positioning hole. One side of a top of the control knob is drilled with a stud receiving groove. An inner wall of the stud receiving groove is formed with a spring receiving groove and an inlet. A spring and a bead are received in the spring receiving groove through the inlet. A positioning pin is placed in the stud receiving groove. The positioning pin has an outer sleeve. One end of the outer sleeve is installed with a stud. An inner side of the stud is formed with two positioning grooves. Thereby, the outer sleeve and the stud of the positioning pin are coupled with the stud receiving groove; then the bead resisting against the spring exactly pushes the positioning groove of the stud to resist against one positioning groove;

wherein, when the control knob rotates to a lock position; the positioning pin will press downwards so that the bead slides to elastically resist against another positioning groove; then, a distal end of the stud is exactly inserted into the positioning hole of the inner cover to lock the control knob. Thereby, the lock is locked at the inner side of the doorplate.

The various objects and advantages of the present invention will be more readily understood from the following detailed description when read in conjunction with the appended drawing.

DETAILED DESCRIPTION OF THE PREFERRED EMBODIMENTS

Figure 1:
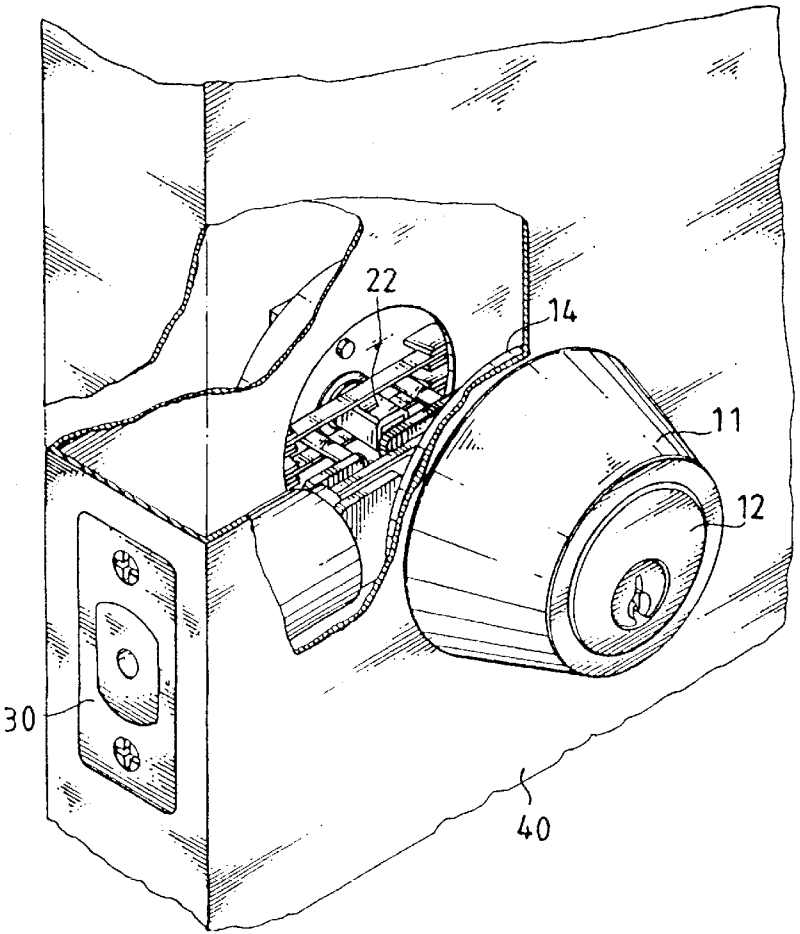
FIG. 1 is an assembled perspective view of the present invention.
Figure 2:
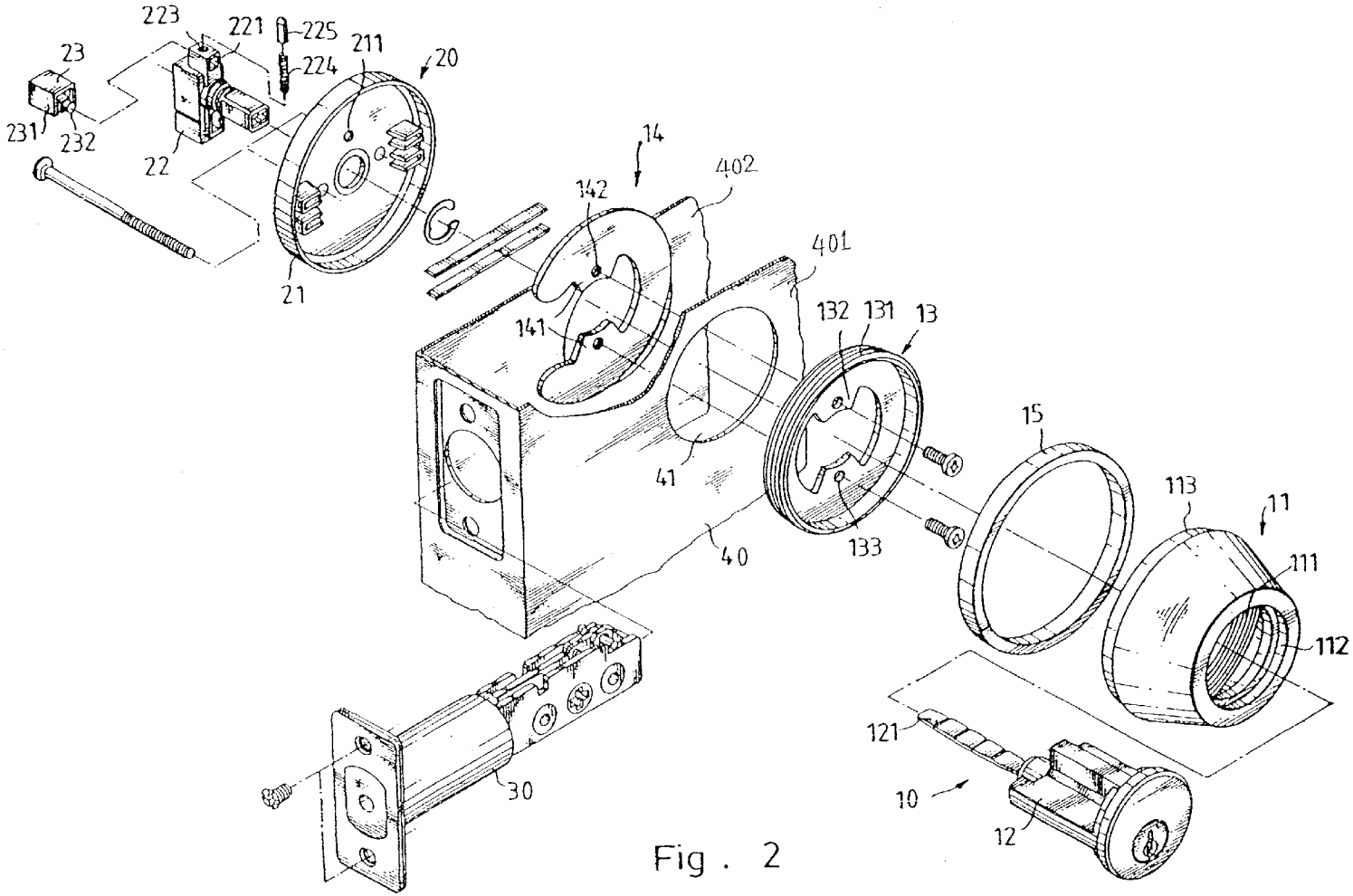
FIG. 2 is an exploded perspective view of the present invention.
Figure 3:
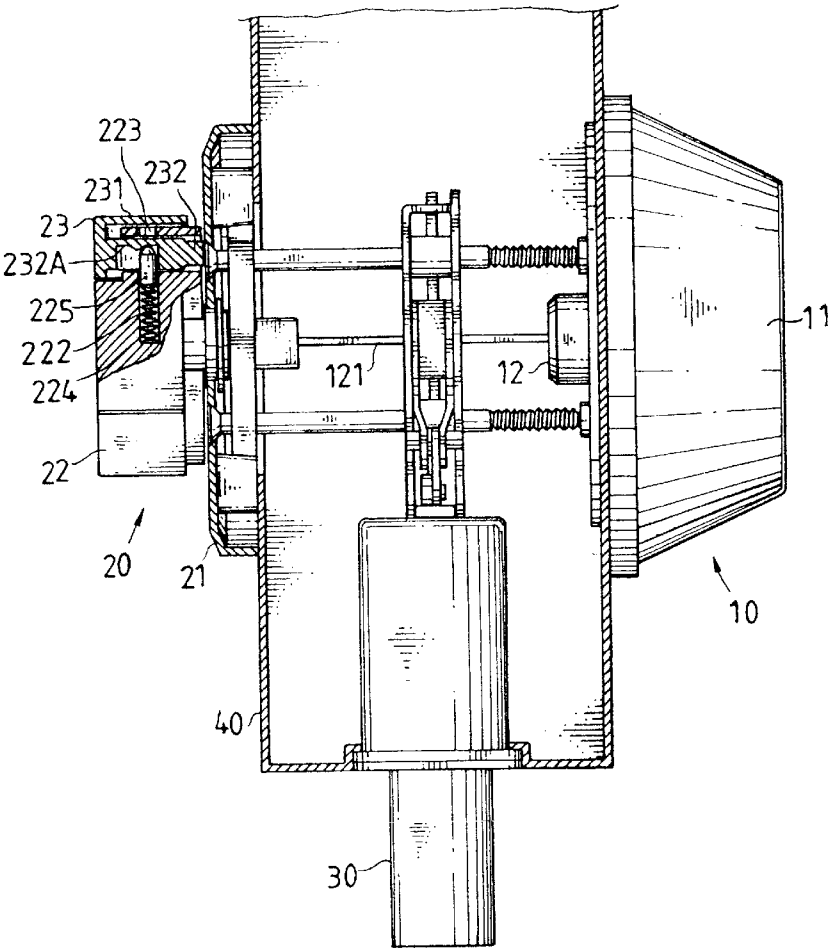
FIG. 3 is an assembled cross sectional view of the present invention.
Figure 4:
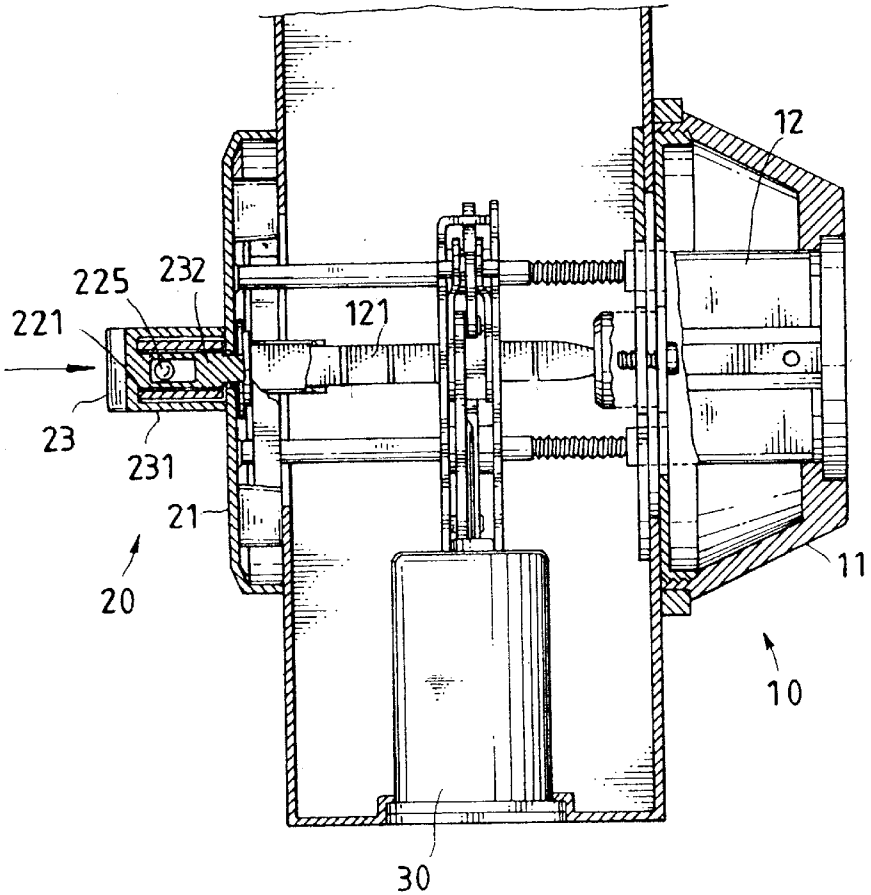
FIG. 4 is a schematic view showing the inner lock structure of the present invention.
Figure 6:
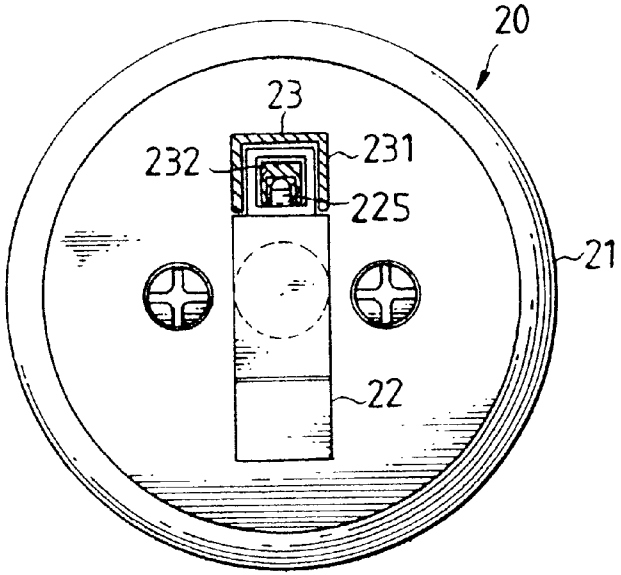
FIG. 6 is a partial schematic cross sectional view showing that the control knob of the present invention is in a lock state.
Figure 5:
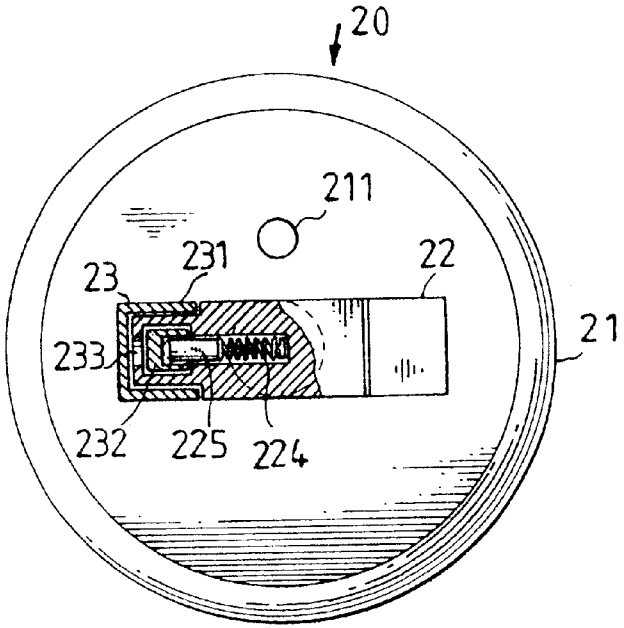
FIG. 5 is a partial schematic cross sectional view showing that the control knob of the present invention is in an unlock state.

Referring to FIGS. 1 to 6, the door lock of the present invention mainly includes an outer lock portion 10, an inner lock portion 20 and a lock pull 30. The door lock of the present invention is locked on a doorplate 40 which is formed by an outer plate 401 and an inner plate 402.

The outer lock portion 10 is installed at an outer side of a lock hole 41 of a doorplate 40 and is formed by an outer lock casing 11, a lock center 12, and a ring seat 13. The inner lock portion 20 is installed at inner side of the lock hole 41 of the doorplate 40. The inner lock portion 20 is formed by an inner cover 21 and a control knob 22. The lock pull 30 is installed at a lateral side of the doorplate 40. The lock pull 30 serves for pulling the lock center 12 of the outer lock portion 10 and the control knob 22 of the inner lock portion 20. The inner cover 21 is locked to the inner doorplate 40 and the control knob 22 is axially installed in a center of the inner cover 21 and is connected to the lock center 12.

The outer lock portion 10 is installed with an enhancing structure and the control knob 22 of the inner lock portion 20 is installed with an inner lock structure. The enhancing structure includes an outer thread 131 on an outer edge of the outer periphery of the ring seat 13. The outer thread 131 is engageable with an inner thread 111 at an inner edge of the outer lock casing 11. An interior of outer plate 401 of the doorplate 40 has a C ring 14 coupled to the outer ring seat 13. The inner side of the ring seat 13 has connecting ears 132 and the inner side of the C ring 14 are installed with connecting ears 141. The connecting ears 132 are configured with respect to the connecting ears 141. Each connecting ear 132 has a penetrating hole 133 and each connecting ear 141 has a screw hole 142. The connecting ears 132 and connecting ears 141 are locked by screws. Thereby, the ring seat 13 and C ring 14 clamp two sides of the outer plate 401 of the doorplate 40 so as to enhance the structure of the doorplate 40 to prevent the door lock from being pulled out.

In the inner lock structure, the inner cover 21 is installed with a positioning hole 211. One side of a top of the control knob 22 is drilled with a stud receiving groove 221. An inner wall of the stud receiving groove 221 is formed with a spring receiving groove 222 and an inlet 223. A spring 224 and a bead 225 are received in the spring receiving groove 222 through the inlet 223. A positioning pin 23 is placed in the stud receiving groove 221. The positioning pin 23 has an outer sleeve 231. One end of the outer sleeve 23 is installed with a stud 232. An inner side of the stud 232 is formed with two positioning grooves 232A. Thereby, the outer sleeve 231 and the stud 232 of the positioning pin 23 can be coupled with the outer side and interior of the stud receiving groove 221. Then the bead 225 resisting against the spring 224 exactly pushes the positioning groove 232A of the stud 232 to resist against one positioning groove 232A.

Thereby, when the control knob 22 rotates to a lock position. The positioning pin 23 will press downwards so that the bead 225 slides to elastically resist against another positioning groove 232A. Then, a distal end of the stud 232 exactly inserts into the positioning hole 211 of the inner cover 21 to lock the control knob 22. Thereby, the lock is locked at the inner side of the doorplate 40.

It should be noted that an outer diameter of the C ring 14 is larger than the lock hole 41 of the outer plate 401 of the doorplate 40. Thereby, a notch of the C ring 14 exactly inserts into an interior of the lock hole 41 so that the assembly work can be performed easily.

The size of the ring seat 13 is approximately equal to that of the C ring 14. Thereby, the ring seat 13 and C ring 14 can clamp the outer plate 401 by screwing the screw hole 142 and penetrating hole 133. Furthermore, the outer lock casing 11 has a tapered shape with an inner larger end. The outer lock casing 11 has a round hole 112 for being engaged with the lock center 12.

An inner edge of the outer lock casing 11 is formed with a reduced ring 113 which is engaged with an 0 ring 15 so that the outer lock casing 11 may rotate idly. Thereby, as the outer lock casing 11 is rotated by force, the inner lock portion 20 will not separate from the long axial stud 121 of the lock center 12.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An enhanced door lock capable of being locked from an inner side of a doorplate; the door lock comprising an outer lock portion, an inner lock portion and a lock pull; wherein the door lock is locked on a doorplate and the doorplate is formed by an outer plate and an inner plate;

the outer lock portion being installed at an outer side of a lock hole of the outer plate and being formed by an outer lock casing, a lock center, and a ring seat;

the inner lock portion being installed at inner side of the lock hole of the inner plate; the inner lock portion being formed by an inner cover and a control knob; the lock pull being installed at a lateral side of the doorplate; the lock pull serving for pulling the lock center of the outer lock portion and the control knob of the inner lock portion; the inner cover being locked to the inner doorplate and the control knob being axially installed in a center of the inner cover and being connected to the lock center; characterized in that:

an outer thread is formed on an outer edge of an outer periphery of the ring seat; the outer thread is engageable with an inner thread at an inner edge of the outer lock casing; an interior of the outer plate of the doorplate has a C ring coupled to the outer ring seat; an inner side of the ring seat has connecting ears and an inner side of the C ring are installed with connecting ears; the connecting ears of the C ring are configured with respect to the connecting ears of the ring seat; each connecting ear has a penetrating hole and each connecting ear has a screw hole; the connecting ears of the C ring and connecting ears of the ring seat are locked by screws; thereby, the ring seat and C ring clamp two sides of the outer plate of the doorplate so as to enhance the structure of the doorplate to prevent the door lock from being pulled out;

the inner cover is installed with a positioning hole; one side of a top of the control knob is drilled with a stud receiving groove; an inner wall of the stud receiving groove is formed with a spring receiving groove and an inlet; a spring and a bead are received in the spring receiving groove through the inlet, a positioning pin is placed in the stud receiving groove; the positioning pin has an outer sleeve; one end of the outer sleeve is installed with a stud; an inner side of the stud is formed with two positioning grooves; thereby, the outer sleeve and the stud of the positioning pin are coupled with the stud receiving groove; then the bead resisting against the spring exactly pushes the positioning groove of the stud to resist against one positioning groove;

wherein, when the control knob rotates to a lock position; the positioning pin will press downwards so that the bead slides to elastically resist against another positioning groove; then, a distal end of the stud exactly inserts into the positioning hole of the inner cover to lock the control knob; thereby, the lock is locked at the inner side of the doorplate.

2. The enhanced door lock capable of being locked from an inner side of a doorplate as claimed in claim 1, wherein an outer diameter of the C ring is larger than a diameter of the lock hole of the outer plate of the doorplate; thereby, a notch of the C ring exactly inserts into an interior of the lock hole so that the assembly work can be performed easily.

3. The enhanced door lock capable of being locked from an inner side of a doorplate as claimed in claim 1, wherein a size of the ring seat is approximately equal to that of the C ring; thereby, the ring seat and C ring clamp the outer plate by screwing the screw hole and penetrating hole.

4. The enhanced door lock capable of being locked from an inner side of a doorplate as claimed in claim 1, wherein the outer lock casing has a tapered shape with a larger end at a side near the door plate; the outer lock casing has a round hole for being engaged with the lock center.

5. The enhanced door lock capable of being locked from an inner side of a doorplate as claimed in claim 1, wherein an inner edge of the outer lock casing is formed with a reduced ring which is engaged with an O ring so that the outer lock casing can rotate idly; thereby, as the outer lock casing is rotated by force, the inner lock portion will not separate from the long axial stud of the lock center.

* * * * *